US010571168B2

(12) United States Patent
Liu et al.

(10) Patent No.: US 10,571,168 B2
(45) Date of Patent: Feb. 25, 2020

(54) METHODS AND SYSTEMS TO MANAGE REFRIGERANT IN A HEAT EXCHANGER

(75) Inventors: Bin Wade Liu, Shanghai (CN); Hai Zhen Lv, Shanghai (CN)

(73) Assignee: TRANE INTERNATIONAL INC., Davidson, NC (US)

( * ) Notice: Subject to any disclaimer, the term of this patent is extended or adjusted under 35 U.S.C. 154(b) by 1061 days.

(21) Appl. No.: 14/425,392

(22) PCT Filed: Sep. 3, 2012

(86) PCT No.: PCT/CN2012/080904

§ 371 (c)(1),
(2), (4) Date: Oct. 23, 2015

(87) PCT Pub. No.: WO2014/032301

PCT Pub. Date: Mar. 6, 2014

(65) Prior Publication Data

US 2016/0040917 A1 Feb. 11, 2016

(51) Int. Cl.

| | |
|---|---|
| ***F25B 39/04*** | (2006.01) |
| ***F25B 40/02*** | (2006.01) |
| ***F25B 43/00*** | (2006.01) |

(52) U.S. Cl.

CPC ..... *F25B 39/04* (2013.01); *F25B 40/02* (2013.01); *F25B 43/006* (2013.01)

(58) Field of Classification Search

CPC ..... F25B 40/00; F25B 40/02; F25B 39/04; F28F 2009/222; F28F 2009/224; F28F 25/02; F28D 3/04

(Continued)

(56) References Cited

U.S. PATENT DOCUMENTS 1,233,138 A * 7/1917 Snow ..... F28B 1/02 165/114
1,791,468 A * 2/1931 Leonard ..... C13B 25/001 165/146

(Continued)

FOREIGN PATENT DOCUMENTS

| | | |
|---|---|---|
| CA | 542943 | 7/1957 |
| CN | 1164638 | 11/1997 |

(Continued)

OTHER PUBLICATIONS

International Search Report and Written Opinion for International Application No. PCT/CN2012/080904, dated Jun. 13, 2013, 13 pgs.

*Primary Examiner* — Tho V Duong
(74) *Attorney, Agent, or Firm* — Hamre, Schumann, Mueller & Larson, P.C.

(57) ABSTRACT

Methods and systems to manage refrigerant flow inside a shell and tube heat exchanger, such as a condenser, to reduce inundation effect are provided. A method of managing refrigerant flow may include collecting at least a portion the refrigerant in the liquid state and directing the collected refrigerant in the liquid state toward an end of an internal space of the condenser. The method may further include directing the refrigerant in the liquid form toward a sub-cooling section. The method may also include directing the collected in the liquid state toward a refrigerant outlet located at proximately a middle section of a length of the condenser through the subcooling section. The condenser may have one or more separation/collection pans positioned within heat transfer tubes to collect and direct the refrigerant in the liquid form. A two-stage refrigerant distributor is also disclosed.

11 Claims, 12 Drawing Sheets

(58) Field of Classification Search
USPC ..... 165/160
See application file for complete search history.

(56) References Cited

U.S. PATENT DOCUMENTS

| | | | | |
|---|---|---|---|---|
| 1,848,741 | A | 3/1932 | Nelson | |
| 1,908,611 | A | 5/1933 | Heimberger et al. | |
| 1,917,595 | A * | 7/1933 | McDermet | F22D 1/32<br>122/459 |
| 2,830,797 | A * | 4/1958 | Garland | F25B 39/04<br>165/110 |
| 2,873,098 | A * | 2/1959 | Morgan | F28F 9/22<br>122/512 |
| 3,134,431 | A * | 5/1964 | Astrup | F28F 9/0219<br>165/160 |
| 5,509,466 | A * | 4/1996 | McQuade | F25B 39/04<br>165/112 |

FOREIGN PATENT DOCUMENTS

| | | |
|---|---|---|
| CN | 101382359 | 3/2009 |
| CN | 202304118 | 7/2012 |
| FR | 351415 | 7/1905 |
| JP | 50090250 | 7/1975 |
| JP | 51105152 | 8/1976 |
| JP | H10185463 | 7/1998 |
| JP | 2001215096 | 8/2001 |
| JP | 4120611 | 7/2008 |

* cited by examiner

METHODS AND SYSTEMS TO MANAGE REFRIGERANT IN A HEAT EXCHANGER

FIELD OF TECHNOLOGY

Embodiments disclosed herein relate generally to a heat exchanger of an air conditioning system. More specifically, the embodiments disclosed herein relate to a shell and tube type heat exchanger, such as a condenser.

BACKGROUND

A heat exchanger of an air conditioning system is typically configured to facilitate heat transfer between two fluids. For example, in a typical shell and tube type heat exchanger, a plurality of heat transfer tubes are positioned inside an internal space of the shell, forming a tube side. The internal space of the shell (the shell side) may be configured to carry the first fluid, and the tube side may be configured to carry the second fluid. The heat exchanger may be configured to help heat transfer between the first fluid and the second fluid in the shell side and the tube side respectively. The heat exchanger can be a condenser. The shell side of the condenser is typically a compressed refrigerant in a vapor state and the tube side of the condenser is generally a coolant, such as water. The coolant in the tube side can cool down the compressed refrigerant in the vapor state in the shell side toward a saturation temperature of the refrigerant, causing the compressed refrigerant in the vapor state to transit into a liquid state. Some condensers can also be configured to have a subcooler to further cool the refrigerant in the liquid state to below the saturation temperature of the refrigerant, producing the subcooled refrigerant. The subcooler is typically positioned toward a lower section close to a bottom of the shell side.

SUMMARY

In a shell and tube condenser, refrigerant in the liquid state may accumulate on surfaces of heat transfer tubes, causing reduction in heat transfer efficiency due to an inundation effect. Methods and systems to manage a refrigerant flow in the shell and tube condenser so as to reduce the inundation effect in a condenser are described. In one embodiment, a method may include cooling the refrigerant in a vapor state so that at least a portion of the refrigerant is the vapor state transits into a liquid state, directing at least a portion of the refrigerant in the liquid state toward an end(s) of an internal space of a condenser. The method may also include at proximately the end(s) of the internal space of the condenser, directing the portion of the refrigerant in the liquid state toward a subcooling section positioned at a bottom of the internal space of the condenser. The method may further include in the subcooling section, directing the portion of the refrigerant in the liquid state toward a refrigerant outlet located at proximately a middle section of the bottom of the internal space of the condenser through the subcooling section.

In some embodiments, a system may include at least one separation/collection pan positioned within a heat transfer tube bundle of the condenser. The separation/collection pan extends in a longitudinal direction defined by a length of the heat transfer tube bundle, and the separation/collection pan may be configured to collect at least a portion of the refrigerant transited from the vapor state to the liquid state and direct the portion of the refrigerant toward an end(s) of an internal space of the condenser. In some embodiments, the separation/collection pan may be configured to have wings extending longitudinally along the separation/collection pan to prevent the refrigerant from flowing out of the separation/collection pan at areas where the wings are located. In some embodiments, the separation/collection pan may be configured to have a cut-out(s) at an end(s) of the separation collection pan so as to allow the portion of the refrigerant in the liquid state to flow out of the separation/collection pan and toward a bottom of the condenser. In some embodiments, the separation/collection pan can be diagonally positioned in relation to a vertical direction of the condenser from an end view.

In some embodiments, the condenser may be configured to have a plurality of separation/collection pans that divide the internal space of the condenser into a plurality of cooling sections. In some embodiments, from an end view, a refrigerant inlet of the condenser may be positioned diagonally in relation to the plurality of cooling sections so that the refrigerant can be directed into the plurality of cooling sections simultaneously.

In some embodiments, the condenser may be configured to have a subcooling section positioned at proximately the bottom of the internal space of the condenser, and the subcooling section may be configured to cool the refrigerant when the portion of the refrigerant flows toward a refrigerant outlet. In some embodiments, the refrigerant outlet may be positioned at proximately a middle section of the bottom of the internal space of the condenser. In some embodiments, the subcooling section may be covered by a partition that may be configured to have a cut-out region(s) at proximately the end(s) of the partition. In some embodiments, the partition can be configured to generally conform to an outline of the subcooling section. In some embodiments, the subcooling section may be configured to have space filling rods between heat transfer tubes of the subcooling section and a shell of the condenser so as to reduce free flow area between the heat transfer tubes of the subcooling section and the shell of the condenser, increasing the contact of the refrigerant with the heat transfer tubes.

A two-stage refrigerant distributor is also described herein. The two-stage refrigerant distributor may be positioned in an internal space of a heat exchanger next to a refrigerant inlet. A first-stage distributor and/or a second-stage distributor may be configured to direct at least a portion of the refrigerant vapor in a direction of a length of the heat exchanger. In some embodiments, the first-stage distributor and/or the second-stage distributor may be configured to allow at least a portion of the refrigerant vapor to pass through. In some embodiments, the first-stage distributor and/or the second-stage distributor may be made of solid material, and can be configured to be a sheet. In some embodiments, the first-stage distributor and/or the second-stage distributor may be configured to have openings or slots to allow the refrigerant vapor to pass through.

In some embodiment, the second-stage distributor may be configured to be longer than the first-stage distributor in a longitudinal direction defined by the length of the heat exchanger.

In some embodiments, the first-stage distributor and/or the second-stage distributor may be configured to extend to about a full length of the length of the heat exchanger.

In some embodiments, the first-stage distributor and/or the second-stage distributor may be configured to be shorter than the full length of the heat exchanger.

In some embodiments, a condenser may be configured to include at least one flow directing baffle extending in a longitudinal direction of the internal space of the shell, where the baffle is configured to direct at least a portion of the refrigerant in the liquid state toward the subcooling section.

In some embodiments, the condenser may be configured to include a second collection pan running in the longitudinal direction of the length of the internal space of the shell positioned within the plurality of heat transfer tubes, where the second collection pan is positioned at a height level that is different from a height level of the first collection pan along the height of the internal space of the shelf.

In some embodiments, the condenser may be configured to include a refrigerant inlet that is positioned diagonally in relation to a vertical direction defined by the height of the internal space of the shell.

In some embodiments, the condenser may be configured so that the separation/collection pan is diagonally positioned in relation to a vertical direction of the condenser.

In some embodiment, the condenser may be configured to include a subcooling section that is positioned proximately a bottom of a shell of the condenser; a partition covering the subcooling section, the partition having at least one wing extending in a longitudinal direction along the partition; where the partition has a roof that generally conforms to a shape of an outline of the subcooling section beneath the partition, and the partition has the at least one wing tilts upwardly and generally conforms to a shape of an internal surface of the shell.

In some embodiments, the condenser may be configured so that at least one end of the partition is configured to have at least one cut-out region to allow a refrigerant in a liquid state to flow out of the partition. In some embodiments, the condenser may be configured so that the subcooling section is configured to have space filling rods between a heat transfer tube of the subcooling section and the shell of the condenser.

In some embodiments, the condenser may be configured so that a side of the separation/collection pan has a wing to prevent refrigerant from flowing out of the separation/collection pan from the side.

In some embodiments, the condenser may be configured so that the separation/collection pan is configured to substantially cover a subcooling region in the internal space of the condenser, the subcooling region includes one or more heat transfer tubes that are located at proximately a bottom of the internal space of the condenser.

In some embodiments, the condenser may be configured so that the separation/collection pan has a cut-out at an end of the subcooling region.

In some embodiments, the condenser may be configured so that the separation/collection pan is configured to generally conform to a shape of an outline of the subcooling region that is defined by the heat transfer tubes in the subcooling regions so as to reduce free flow area between the separation/collection pan and the heat transfer tubes in the subcooling region.

In some embodiments, a refrigerant distributor for a heat exchanger may be configured to include a refrigerant inlet, a first-stage distributor positioned next to the refrigerant inlet, the first-stage distributor extending in a longitudinal direction of a length of the heat exchanger, and a second-stage distributor positioned next to the first-stage distributor, the second-stage distributor extending in the longitudinal direction of the length of the heat exchanger.

In some embodiments, the refrigerant distributor may be configured so that the first-stage distributor and/or the second-stage distributor are made of a sheet material.

In some embodiments, the refrigerant distributor of may be configured so that the first-stage distributor and/or the second-stage distributor include one opening that is configured to allow refrigerant to pass through.

In some embodiments, the refrigerant distributor may be configured so that the second-stage distributor is longer than the first-stage distributor.

In some embodiments, the refrigerant distributor may be configured so that the first-stage distributor is a member with pores.

In some embodiments, the refrigerant distributor may be configured so that the first-stage distributor and/or the second-stage distributor is configured to allow at least a portion of refrigerant vapor to pass through, and direct a portion of the refrigerant vapor to flow in a direction of the length of the heat exchanger.

In some embodiments, the refrigerant distributor may be configured so that the refrigerant distributor is positioned diagonally in relation to a vertical direction of the heat exchanger.

In some embodiments, the refrigerant distributor may be configured so that the first-stage distributor and/or the second-stage distributor has a plurality of rows of the openings.

In some embodiments, the refrigerant distributor may be configured so that the first-stage distributor and/or the second-stage distributor has a variable width along a length of the first-stage distributor and/or the second-stage distributor.

In some embodiments, the refrigerant distributor may be configured so that profiles of the first-stage distributor and/or the second-stage distributor are about rectangular.

In some embodiments, the refrigerant distributor may be configured so that the variable width is the widest at about a middle section of the length of the first-stage distributor and/or the second-stage distributor.

In some embodiments, a method of managing a refrigerant in a condenser may be configured to include directing a refrigerant in a vapor state into an internal space of the condenser; cooling the refrigerant vapor so that at least a portion of the refrigerant in the vapor state transits into a liquid state; directing at least a portion of the refrigerant in the liquid stale toward proximately an end of the internal space of the condenser; at proximately the end of the internal space of the condenser, directing the at least a portion of the refrigerant in the liquid state toward a bottom of the internal space of the condenser; and directing the at least a portion of the refrigerant in the liquid state toward a refrigerant outlet located at proximately a middle section of the bottom of the internal space of the condenser.

In some embodiments, the method of managing a refrigerant in a condenser may be configured to include during directing at least a portion of the refrigerant in the liquid state toward a refrigerant outlet located proximately a middle section of the bottom of the internal space of the condenser, cooling at least a portion of the refrigerant in the liquid state.

In some embodiments, the method of managing a refrigerant in a condenser may be configured to include collecting at least a portion of the refrigerant in the liquid state at a plurality of height levels along a height of the internal space of the condenser.

In some embodiments, the method of managing a refrigerant in a condenser may be configured to include collecting at least a portion of the refrigerant in the liquid state on a substantial portion of a length of the internal space of the condenser.

BRIEF DESCRIPTION OF THE DRAWINGS

FIG. 2A is a side view and FIG. 2B is an end view.

FIG. 5A is an end view of the condenser. FIG. 5B is an elevated perspective view of the subcooling section partition. FIG. 5C is an end view of the subcooling section partition.

FIG. 8A is a side view and FIG. 8B is a bottom view of two-stage distributors respectively. FIG. 8C illustrates an exemplary profile for a two-stage distributor. FIG. 8D illustrates a two-stage distributor positioned diagonally in relation to a vertical direction of a heat exchanger. FIG. 8E illustrates an embodiment of a distributor that can be adapted as a first and/or second distributor of the two-stage distributor.

DETAILED DESCRIPTION

Figure 1:
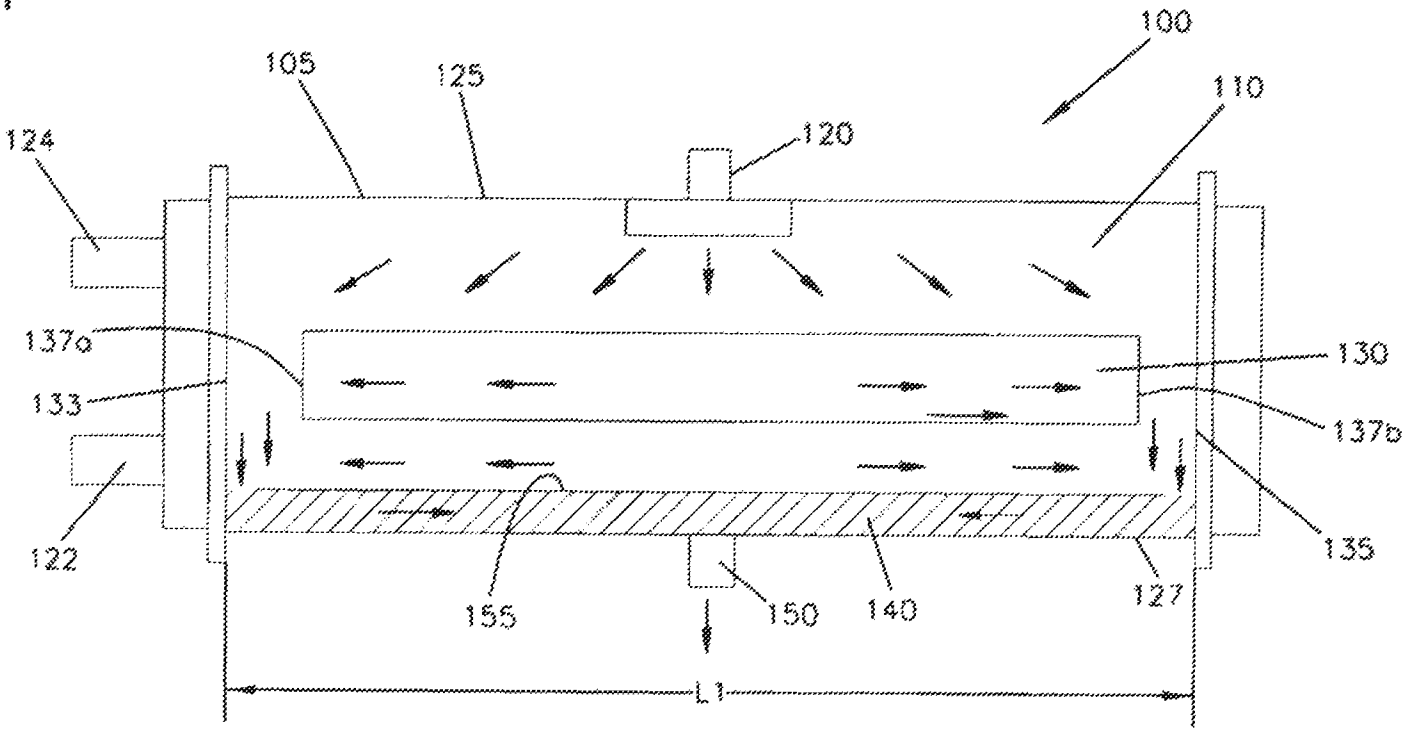
FIG. 1 illustrates a schematic view of an embodiment to manage a refrigerant inside a shell and tube condenser.

An air conditioning system, particularly an air conditioning system with a large capacity such as over 30 tons, can be configured to use a shell and tube type heat exchanger. The shell and tube type heat exchanger typically is configured to have a plurality of hollow heat transfer tubes running longitudinally along an internal space of a shell of the heat exchanger, forming a tube side. The internal space of the shell of the heat exchanger (the shell side) and the tube side may be configured to carry a first fluid and a second fluid respectively. Heat transfer can happen between the first fluid in the shell side and the second fluid in the tube side. For example, in a shell and tube type condenser, the shell side is typically a refrigerant. The tube side is typically a coolant, such as water that runs through the heat transfer tubes. The refrigerant may be firstly directed into the shell side in a vapor state. In the shell and tube type condenser, the compressed refrigerant vapor can transfer heat with the running water in the tube side, and be cooled down by the running water. When the compressed refrigerant vapor is cooled down toward about a saturation temperature of the refrigerant, the refrigerant can transit from the vapor state to a liquid state. The refrigerant in the liquid state may be directed out of the internal space of the condenser and flow toward an evaporator. Some condensers may have a subcooling section, which can be generally located at the bottom of the internal space of the condenser. The subcooling section may be configured to cool the refrigerant in the liquid state to further below the saturation temperature before the refrigerant in the liquid state flows out of the condenser. In some condensers, the subcooling section may be an enclosed subcooling box.

To help heat transfer between the water in the tube side and the refrigerant in the shell side of the condenser, the plurality of the heat transfer tubes in the tube side are typically made of a heat conducting material, such as copper. Heat transfer efficiency of the tubes may be affected by an inundation effect. The inundation effect happens when a portion of the refrigerant in the liquid state remains on surfaces of the heat transfer tubes or migrate to surfaces of other heat transfer tubes during the transition of the refrigerant from the vapor state to the liquid state, thus reducing the heat transfer efficiency of the heat transfer tubes. This inundation effect may be more prominent when the condenser has a relative high number of heat transfer tube rows, for example over 20 to 40 rows. The heat transfer tubes closer to the bottom of the internal space of the condenser may be affected more than the heat transfer tubes closer to a top of the internal space of the condenser because more refrigerant in the liquid state is present closer to the bottom of the internal space of the condenser.

In the following description, methods and systems to reduce the inundation effect in a condenser are described. In one embodiment, a method may include when the refrigerant in a vapor state transits into a liquid state, directing at least a portion of the refrigerant in the liquid state toward an end(s) of an internal space of a condenser. The method may also include at proximately the end(s) of the internal space of the condenser, directing the portion of the refrigerant in the liquid state toward a subcooling section of the condenser positioned at a bottom of the internal space of the condenser. The method may further include in the subcooling section, directing the portion of the refrigerant in the liquid state toward a refrigerant outlet. In some embodiments, the refrigerant outlet may be located at proximately a middle section of the bottom of the internal space of the condenser through the subcooling section. In some embodiments, a system may include at least one separation/collection pan positioned within a heat transfer tube bundle of the condenser, and the separation/collection pan may be configured to collect at least a portion of the refrigerant transited from the vapor state to the liquid state and direct the portion of the refrigerant toward an end(s) of an internal space of the condenser. In some embodiments, the separation/collection pan may be configured to have a cut-out(s) approximately the end(s) of the separation/collection pan so as to allow the portion of the refrigerant to flow toward a bottom of the condenser through the cut-out(s). In some embodiments, the condenser may be configured to have a subcooling section at proximately the bottom of the internal space of the condenser, and the subcooling section may be configured to cool the refrigerant when the portion of the refrigerant flows toward a refrigerant outlet positioned at proximately a middle section of the bottom of the internal space of the condenser. In some embodiments, the subcooling section may be covered by a partition that may be configured to have a cut-out(s) at proximately the end(s) of the partition. In some embodiments, the subcooling section may be configured to have space filling rods between heat transfer tubes of the subcooling section and a shell of the condenser so as to reduce free flow area between the heat transfer tubes of the subcooling section and the refrigerant, increasing contact between the refrigerant and the heat transfer tubes.

References are made to the accompanying drawings that form a part hereof, and in which is shown by way of illustration of the embodiments in which the embodiments may be practiced. It is to be understood that the terms used herein are for the purpose of describing the figures and embodiments and should not be regarding as limiting the scope of the present application. It is appreciated that a refrigerant state in a condenser is dynamic. The terms such as a refrigerant in a liquid state, a refrigerant in a vapor state, a portion of the refrigerant in a liquid state, and the similar terms are not absolute. The refrigerant can constantly change from one state (such as the vapor state) to another state (such as the liquid state).

Referring to FIG. 1, a method of managing a refrigerant in an internal space 110 of a shell and tube condenser 100 is shown. The condenser 100 has a shell 105 defining the internal space 110. Arrows generally indicate the directions of refrigerant flows inside the internal space 110 of the shell 105. The refrigerant is directed into the internal space 110 of the shell 105 through a refrigerant inlet 120. At the refrigerant inlet 120, the refrigerant is typically in a compressed vapor state and can transit to a liquid state in the internal space 110 by, for example, heat transfer through heat transfer tubes. Generally, the method of managing the refrigerant in the internal space 110 of the shell 105 includes directing the refrigerant in the liquid state toward a collection and redirecting zone 130, collecting at least a portion of the refrigerant in the liquid state and then redirecting the collected refrigerant toward a first end 133 and/or a second end 135 of the internal space 110 in the collection and redirecting zone 130. The method also generally includes directing the collected refrigerant toward a subcooling zone 140 that is positioned at proximately a bottom 127 of the internal space 110, and directing the refrigerant toward a refrigerant outlet 150 of the shell 105, for example, can be located about a middle section of a length L1 of the internal space 110. The collection and redirecting zone 130 extends in a longitudinal direction that is defined by the length L1. The longitudinal direction coincides generally with a direction of heat transfer tubes running across the internal space 110.

The subcooling zone 140 can further have a partition 155 generally extending longitudinally that is configured to substantially cover the subcooling zone 140 and separate the subcooling zone 140 from other portions of the internal space 110. The partition 155 is generally refrigerant impermeable so that refrigerant accumulated on the partition 155 can be directed toward the first end 133 and/or the second end 135 of the internal space 110 of the shell 105, then toward the subcooling zone 140, and subsequently toward the refrigerant outlet 150 through the subcooling zone 140.

Figure 3:
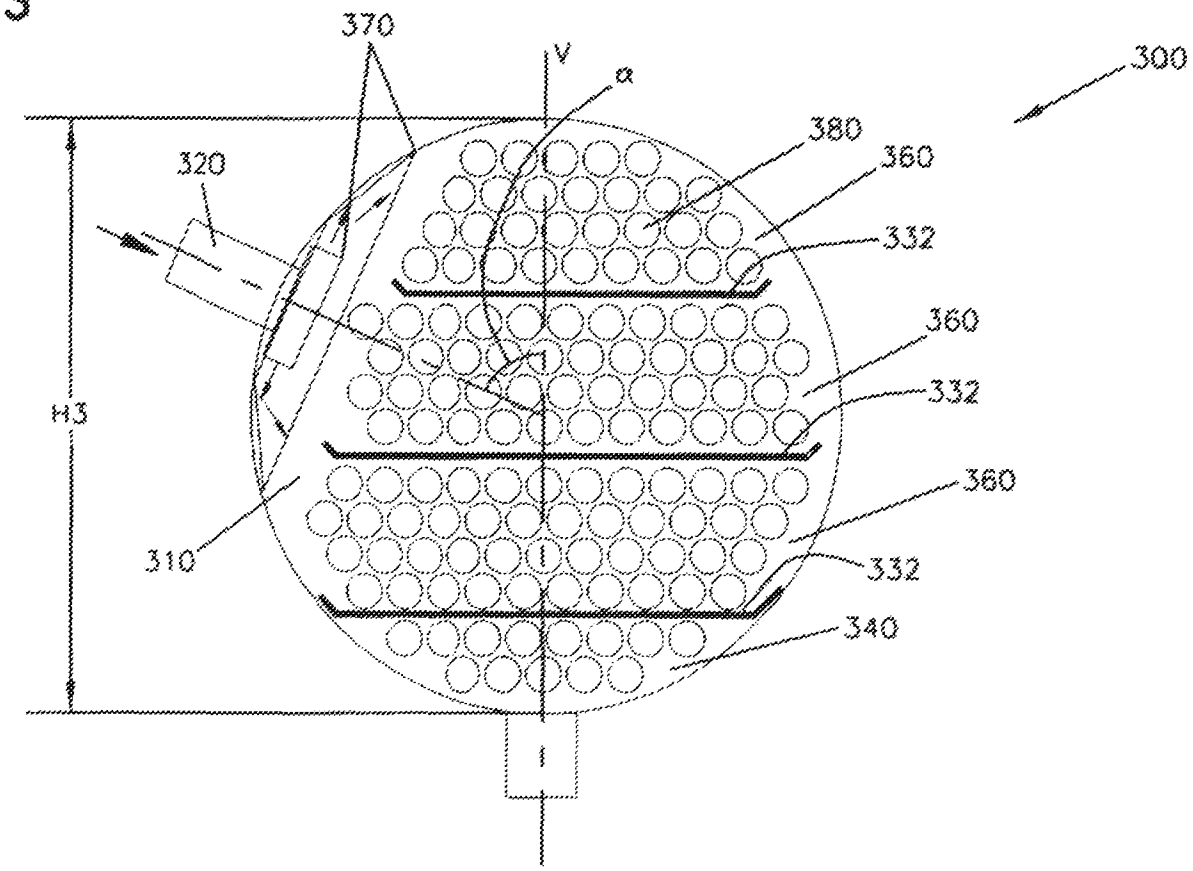
FIG. 3 illustrates another embodiment of a condenser with a refrigerant management apparatus.

In operation, in the internal space 110 of the shell 105, the refrigerant in the vapor state can contact heat transfer tubes (such as heat transfer tubes 380 as illustrated in FIG. 3) that are configured to be in fluid communication with a water inlet 122 and a water outlet 124. The water in the heat transfer tubes typically has a temperature that is lower than the refrigerant in the compressed vapor state. Heat transfer can happen between the refrigerant in the compressed vapor state and the water in the heat transfer tubes. When the refrigerant in the compressed vapor state are cooled down to about a saturation temperature of the refrigerant, at least a portion of the refrigerant can transit into a liquid state. The refrigerant in the liquid state can flow downwardly at least because of gravity.

The method of managing the refrigerant in the internal space 110 of the shell 105 also includes collecting at least a portion of the refrigerant in the liquid state in the collection and redirecting zone 130 that is positioned at an intermediate position between a top 125 and the bottom 127 of the shell 105. The collection and redirecting zone 130 extends in the longitudinal direction that is defined by the length L1 of the internal space 110 of the shell 105. In some embodiments, the collection and redirection zone 130 can extend to proximately the first and/or the second ends 133 and 135 respectively, but leave spaces between the collection and redirection zone 130 and the first and/or the second ends 133 and 135 respectively. Consequently, the refrigerant in the liquid state can be directed to near the first end 133 and/or the second 135 by the collection and redirecting zone 130. At proximately the first end 133 and/or the second end 135 of the internal space 110, the collection and redirecting zone 130 can be configured to have a first opening 137*a* and/or a second opening 137*b* respectively. The opening(s) 137*a* and/or 137*b* are configured to direct the refrigerant in the liquid state toward the subcooling zone 140 located at proximately the bottom 127 of the internal space 110 of the shell 105.

The subcooling zone 140 is generally defined by a few rows, such as 2-4 rows, of heat transfer tubes located at proximately the bottom most portion of the internal space 110 of the shell 105. The refrigerant in the liquid state can be directed into the subcooling zone 140 from the first end 133 and/or the second end 135. The refrigerant can then be directed toward the refrigerant outlet 150 located, for example, about the middle section of the length L1 through the subcooling zone 140.

It is to be appreciated that the refrigerant outlet can be positioned in any place along the length of the shell. In the illustrated embodiment in FIG. 1, positioning the refrigerant outlet 150 at a middle section of the shell 105 helps evenly subcooling of the refrigerant flowing from both ends 133 and 135 of the condenser 100. In some other embodiments, the refrigerant can be directed to only one end of the condenser (e.g. the first end 133 or the second 135). The refrigerant outlet can be positioned close to an end that is opposite to the end to which the refrigerant is directed to. Positioning the refrigerant outlet away from the end to which the refrigerant is directed by the collection and redirecting zone may help subcool the refrigerant by the subcooling section.

Figure 2A:
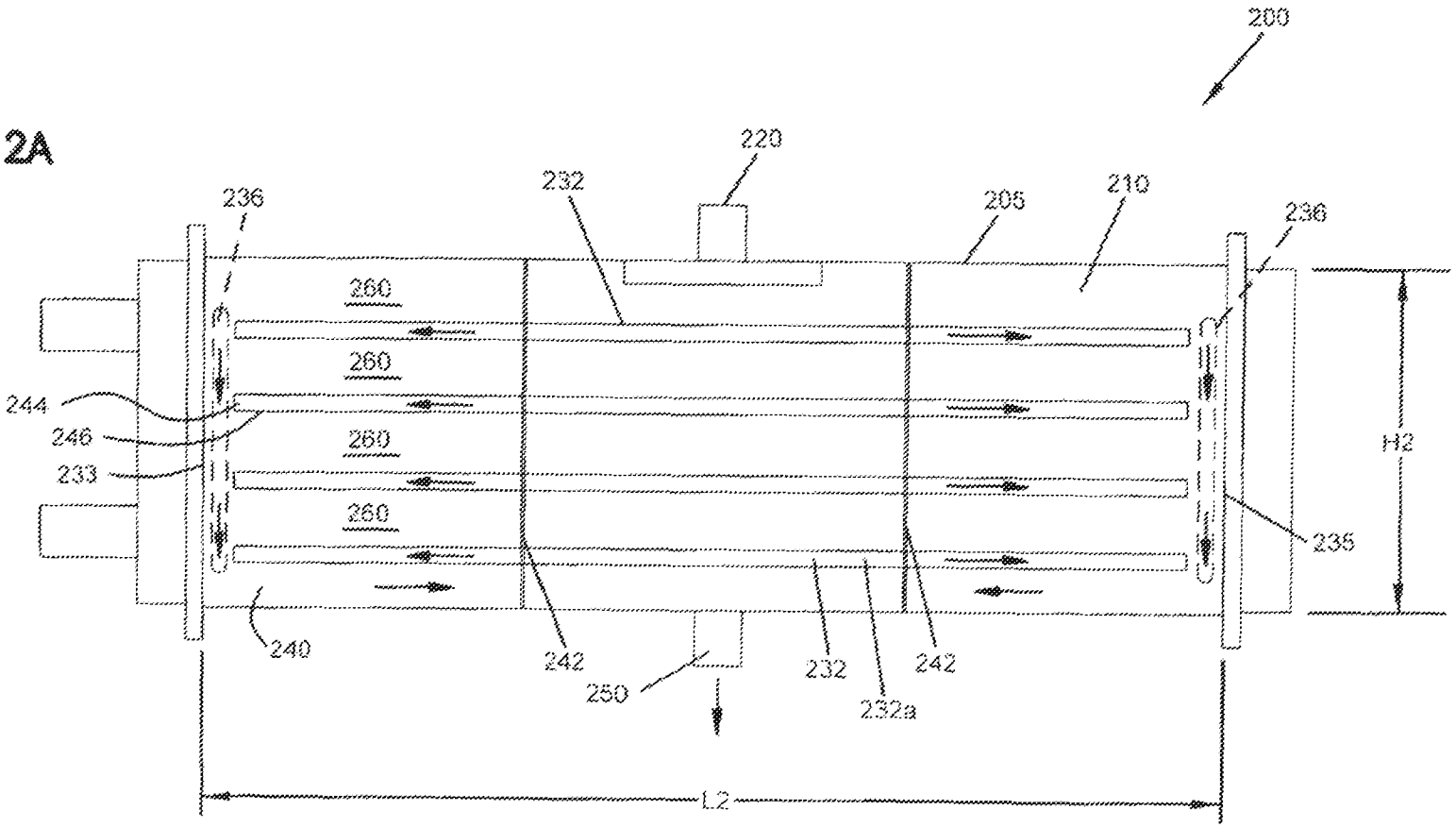
FIGS. 2A and 2B illustrate one embodiment of a condenser with a refrigerant management apparatus inside the condenser.
Figure 2B:
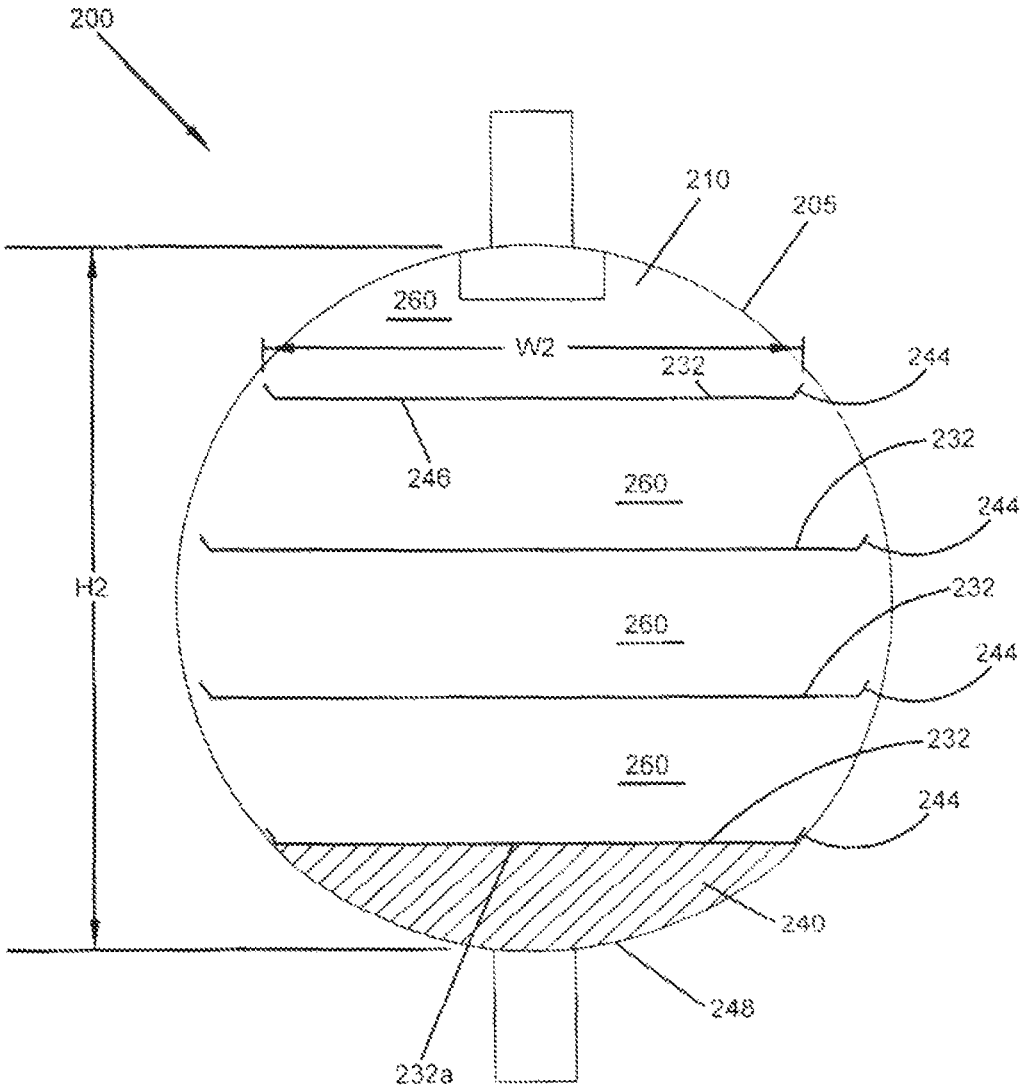

FIGS. 2A and 2B illustrate an embodiment of a shell and tube type condenser 200 that is configured to have a refrigerant collection/redirection apparatus to manage a refrigerant flow inside the condenser 200. Heat transfer tubes of the condenser 200 are not illustrated for clarification purposes. The condenser 200 has a shell 205 that has an internal space 210. The shell has a refrigerant inlet 220 and a refrigerant outlet 250. The refrigerant collection/redirection apparatus includes a separation/collection pan(s) 232 positioned in the internal space 210 of the shell 205. The separation/collection pan(s) 232 can extend, for example, in a longitudinal direction defined by a length L2 of the internal space 210 of the shell 205, and is generally parallel to the longitudinal direction that is defined by the length L2. The separation/collection pan 232 may or may not extend to the full length L2 of the internal space 210 of the shell 205. As illustrated in FIG. 2A, the separation/collection pan 232 is configured to have a cut-out region(s) 236 at an end of the separation/collection pan 232 so as to form a space between the ends of the separation/collection pan 232 and a first end 233 and/or a second end 235 of the internal space 210. The cut-out region(s) 236 is configured to allow a refrigerant to flow out of the separation/collection pan 232.

As discussed above for FIG. 1, the subcooling region 140 as illustrated in FIG. 1 can be substantially covered by the partition 155. As illustrated in FIG. 2A, one of the separation/collection pan(s) 232 allocated at a lower portion of the internal space 210 can be used as a partition to cover a subcooling region 240 of the internal space 210.

When more than one separating/collection pan 232 is used in the internal space 210, individual separation/collection pans 232 can be arranged at different height levels in a vertical direction defined by a height H2 of the internal space 210. The individual separation/collection pans can be configured generally to have the same or about the same length.

The separation/collecting pan(s) 232 can be held in position inside the internal space 210 by at least one supporting member 242.

Referring to FIGS. 2A and 2B, more details of the separation/collection pan(s) 232 are described. As illustrated by an end view of the condenser 200 as illustrated in FIG. 2B, the separation/collection pan(s) 232 has wings 244 extending in the longitudinal direction that is defined by length L2 (as illustrated in FIG. 2A). The wings 244 typically tilt upwardly. An individual separation/collection pan 232 has two wings 244 extending along two sides of the separation/collection pans 232. The separation/collection pan(s) 232 also has a bottom 246 extending in the longitudinal direction, as illustrated in FIGS. 2A and 2B. The bottom 246 is typically configured to be generally planar. The wings 244 and the bottom 246 are configured to form a trenched shape with a generally flat bottom from the end view as illustrated in FIG. 2B.

Further illustrated in FIG. 2B, from the end view the internal space 210 of the condenser 200 generally has a circular end profile. The internal space 210 can have more than one separation/collection pans 232 that are arranged at different height levels in the vertical direction defined by the height H2. The vertically arranged separation/collection pans 232 are generally parallel to each other. In the embodiment as shown in FIG. 2B, each of the individual separation/collection pans 232 has a width W2 that is substantially the same as or smaller than a corresponding chord length of the circular end profile of the condenser 200. It is noted that the width W2 of the individual separation/collection pans 232 may be different.

As discussed above for FIG. 2A, and also as shown in FIG. 2B, the subcooling region 240 is generally located proximately at a bottom 248 of the internal space 210 of the condenser 200. In the illustrated embodiment in FIG. 2B, the subcooling region 240 is substantially covered and separated from other portions of the internal space 210 of the condenser by one of the separation/collection pan 232*a* that is positioned close to the bottom 248 of the internal space 210.

Referring to both FIGS. 2A and 2B, the operation of the condenser 200 is further described. The arrows in FIG. 2A illustrate a flow direction of a refrigerant in a liquid state. In operation, the refrigerant in a compressed vapor state is directed into the internal space 210 of the shell 205 from the refrigerant inlet 220. The refrigerant in the compressed vapor state can be cooled down by, for example, running water in the heat transfer tubes (such as heat transfer tubes 380 as illustrated in FIG. 3, but omitted from FIGS. 2A and 2B for clarification). After being cooled down, at least a portion of the refrigerant in the vapor state may transit into the refrigerant in the liquid state. Because of gravity at least, the refrigerant in the liquid state moves downwardly toward the bottom 248 of the internal space 210. The separation/collection pan(s) 232 is configured to collect the refrigerant in the liquid state that is dripped onto the separation/collection pan(s) 232. The separation/collection pan(s) 232 then directs the collected refrigerant in the liquid state toward the cut-out region(s) 236 that is located at proximately the first end 233 and/or the second end 235 of the internal space 210. The upwardly tilted wings 244 can prevent the collected refrigerant in the liquid state from flowing out of the separation/collection pan(s) 232 from the sides of the separation/collection pan(s) 232, where the wings 244 exist. When the refrigerant in the liquid state flows out of the separation/collection pan(s) 232 in the cut-out region(s) 236, the refrigerant in the liquid state is then directed toward the subcooling region 240 at least due to gravity from the first end 233 and/or the second 235. Thus, the separation/collection pan(s) 232 configuration can function as a collection/separation zone 130 as described in FIG. 1.

In some embodiments, more than one separation/collection pans 232 can be used. The embodiment as illustrated in FIGS. 2A and 2B is configured to have four collection/separation pans 232 that in some examples can generally have a similar length. In this embodiment, the separation/collection pans 232 are arranged vertically at four different height levels along the vertical direction defined by the height H2. The separation/collection pans 232 and the shell 205 can divide the internal space 210 into four cooling sections 260, and one subcooling section 240. In each of the cooling section(s) 260, a portion of the refrigerant in the compressed vapor state can transit into the liquid state. At least a portion of the refrigerant in the liquid state in each of the sections 260 can be collected by the corresponding separation/collection pan 232. Therefore, a substantial portion of the refrigerant in the liquid state in each of the sections 260 does not flow to the other section(s) 260. This may help reduce an inundation effect compared to a condenser without the separation/collection pans. Consequently the efficiency of the condenser 200 may increase compared to a condenser without the separation/collection pans 232.

In the embodiment as shown in FIGS. 2A and 2B, the refrigerant inlet 220 is positioned on top of the shell 205, and can be arranged about vertically relative to the separation/collection pans 232. The refrigerant directed into the internal space 210 of the shell 205 generally flows to the cooling section 260 that is closer to the refrigerant inlet 220 first, then flows to the next cooling sections 260 that are further away from the inlet 220 subsequently in the vertical orientation.

In another embodiment of a condenser 300 as shown in FIG. 3, a refrigerant inlet 320 is positioned at an angle $\alpha$ in relation to a vertical direction V that is defined by a height H3 of an internal space 310 of the condenser 300 from an end view. The angle $\alpha$ between the refrigerant inlet 320 and the vertical direction V may be from about 0 to about 90 degrees, preferably from about 30 to about 60 degrees.

From the internal space 310, the refrigerant inlet 320 is equipped with a refrigerant distributor 370. As illustrated in FIG. 3, because the refrigerant inlet 320 is positioned at the angle $\alpha$ in relation to the vertical line V, the refrigerant distributor 370 is in direct fluid communication with multiple cooling-sections 360 that are generally parallel to each other. Consequently, in operation, the refrigerant in the vapor statefrom the refrigerant inlet 320 can be directed to multiple cooling sections 360 at about the same time, which may helpcool down the refrigerant is the vapor state so as to transit into the refrigerant in the liquid state.

In the embodiment as illustrated in FIG. 3, the separation/collection pans 332 are separated by about a heat transfer tube bundle of four rows of heat transfer tubes 380 from each other. It is appreciated that this is exemplary; the separation/collection pans 332 can be separated by any number of rows of heat transfer tubes 380. In some embodiments, the number can be from 3 to 9. In some embodiments, the number can be optimized by comparing the efficiency of the condenser 300 with different numbers of heat transfer tube rows 380 between separation/collection pans 332 and determining the number associated with the highest efficiency.

Figure 4A:
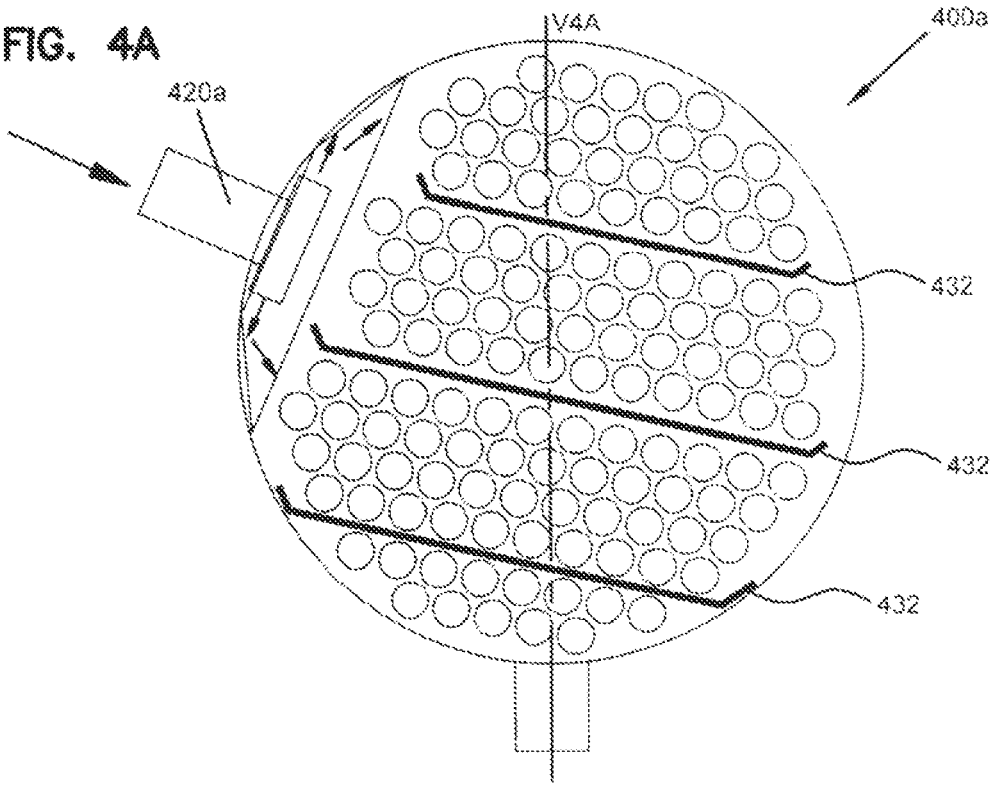
FIGS. 4A to 4C illustrate three more embodiments of a condenser with a refrigerant management apparatus.
Figure 4B:
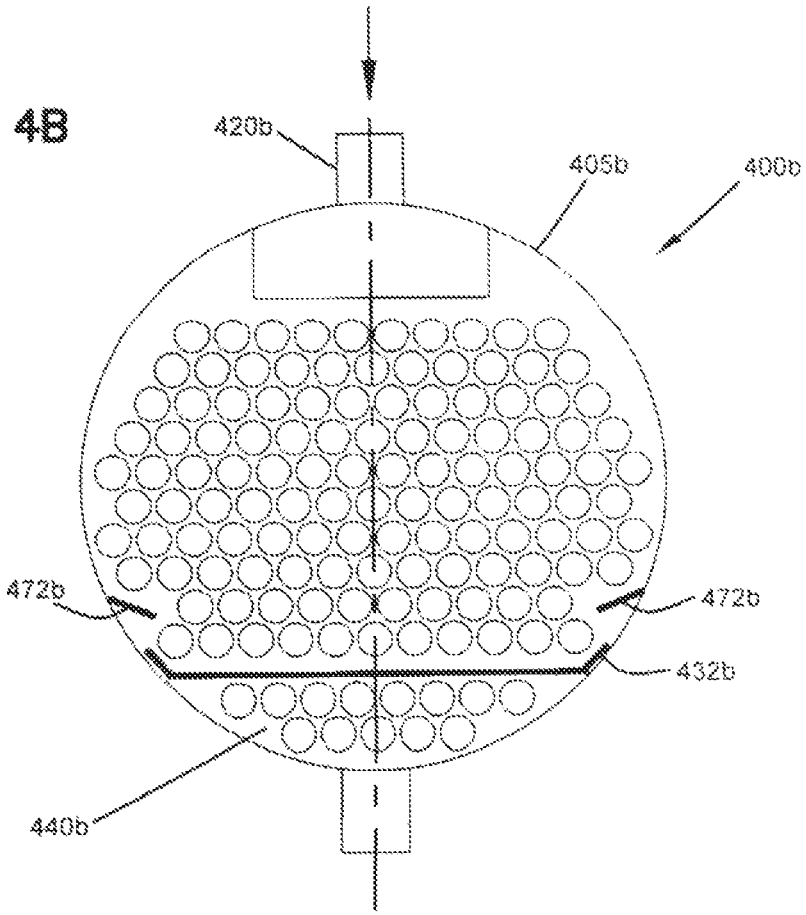
Figure 4C:
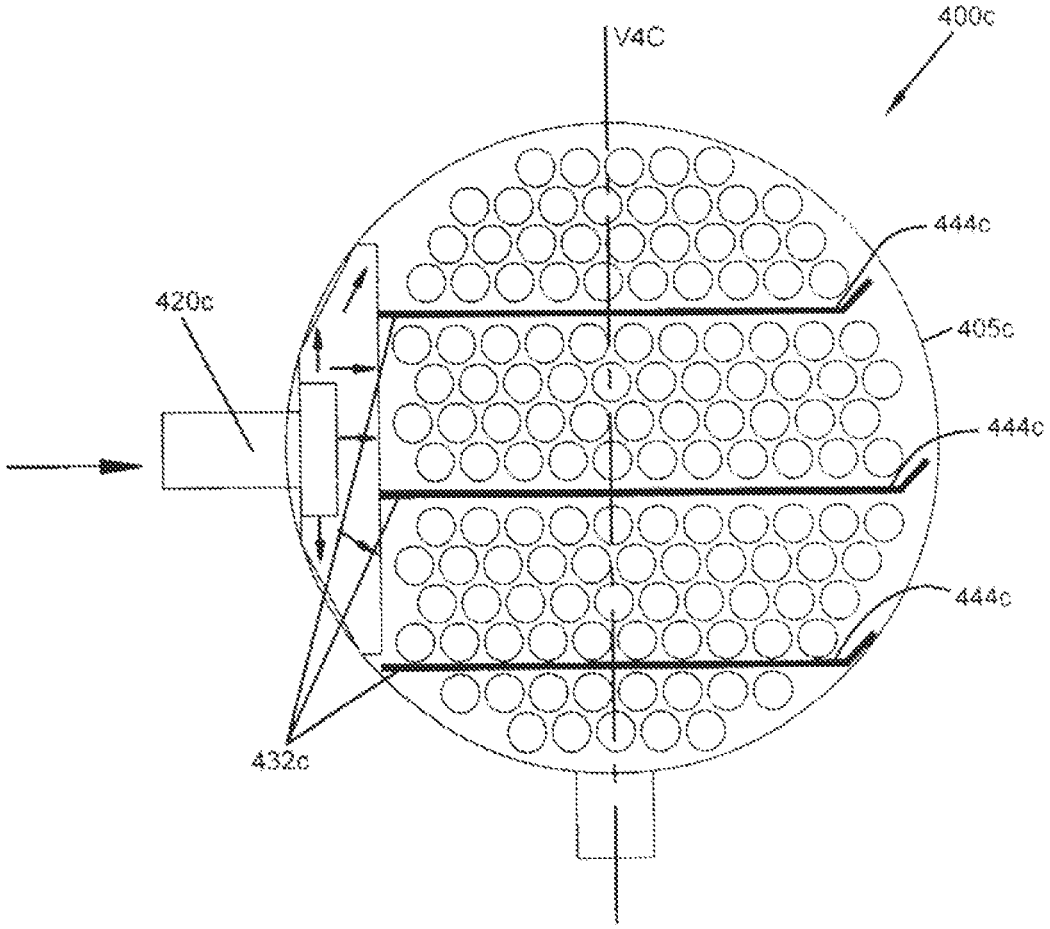

FIGS. 4A to 4C illustrate an end view of three embodiments of a condenser 400*a*, 400*b* or 400*c* respectively with a collection/redirection apparatus to manage a refrigerant flow. Similar to the embodiment as illustrated in FIG. 3, the condenser 400*a* as shown in FIG. 4A has a refrigerant inlet 420*a* that is positioned at an angle in relation to a vertical orientation V4A, which is similarly to the vertical orientation V as described in FIG. 3. The separation/collection pans 432*a* are also positioned at an angle in relation to the vertical line V4A. The angularly positioned separation/collection pans 432*a* may help direct small droplets of the refrigerant in the liquid state toward a lower side of the tilted separation/collection pans 432*a* to form a refrigerant liquid flow on the lower side of the tilted separation/collection pans 432*a*.

In another embodiment as illustrated in FIG. 4B, a condenser 400*b* has a refrigerant inlet 420*b* that is positioned about a top of the condenser 400*b*. The condenser 400 is configured to have at least one flow directing baffle 472*b* that is attached to an internal surface of a shell 405*b* of the condenser 400*b*. The flow directing baffle 472*b* can be configured to extend in a longitudinal direction defined by a length of the condenser (such as the length L2 as illustrated in FIG. 2). The flow directing baffle 472*b* may or may not extend the full length of the condenser. In some embodiments, the flow directing baffle 427*b* may extend the full length of the condenser so that the flow directing baffle 427*b* can direct refrigerant downwardly along the full length of the condenser. The flow directing baffle 472*b* is configured to point downwardly, such that the flow directing baffle 472*b* may help direct the refrigerant in the liquid stale toward a lower separation/collection pan 432*b* that generally covers a subooling area 440*b*. In the embodiment as illustrated in FIG. 4B, the condenser 400*b* is configured to have just one lower separation/collection pan 432*b* that covers the subcooling area 440*b*. On the lower separation/collection pan 432*b*, the refrigerant in the liquid form may be directed toward one or both ends of the shell 405 (such as the first end 233 and/or the second end 235 of the shell 205 as illustrated in FIG. 2A), and then directed into the subcooling zone 440*b* underneath the lower separation/collection pan 432*b*.

In the embodiment as illustrated in FIG. 4C, the condenser 400*c* has a refrigerant inlet 420*c* that is positioned at about 90 degrees in relation to a vertical orientation V4C. In the end view as shown in FIG. 4C, the refrigerant inlet 420*c* can be configured to direct a refrigerant into a shell 405*c* from a left side of the condenser 400*c*. Because the refrigerant in the vapor state is directed from the left side, the cooling of the refrigerant in the vapor state and the transition from the vapor state to the liquid state is more likely to happen toward the right side of the shell 405*c*. Accordingly, only one wing 444*c* that is located near the right side of the shell 405*c* may be needed for each of separation/collection pans 432*c*. By removing the wing(s) on the left side of the separation/collection pans 432*c* that may block refrigerant flow from the refrigerant inlet 420*c*, this one wing configuration may help the refrigerant in the vapor state to enter the shell 405C.

As described above, the number of separation/collection pans in a condenser may vary. In some embodiments, such as the condenser 400*b* as illustrated in FIG. 4B, the condenser can be configured to have just one lower separation/collection pan. Particularly for a shell and tube condenser with a relative small capacity, such as 40-120 tons, the lower separation/collection pan may be configured to generally conform to a shape of a internal surface of a shell of the condenser as well as heat transfer tubes located at proximately the bottom of the shell to define a subcooling area within the shell. (See FIGS. 5A to 5C.)

It is to be appreciated that the embodiments illustrated in FIGS. 4A to 4C are exemplary. A condenser may have any one or any combination of the features as illustrated in FIGS. 4A to 4C. For example, the flow direction baffle 472*b* may be used in an embodiment with a plurality of separation/collection pans (e.g. FIG. 4A or 4C).

Figure 5A:
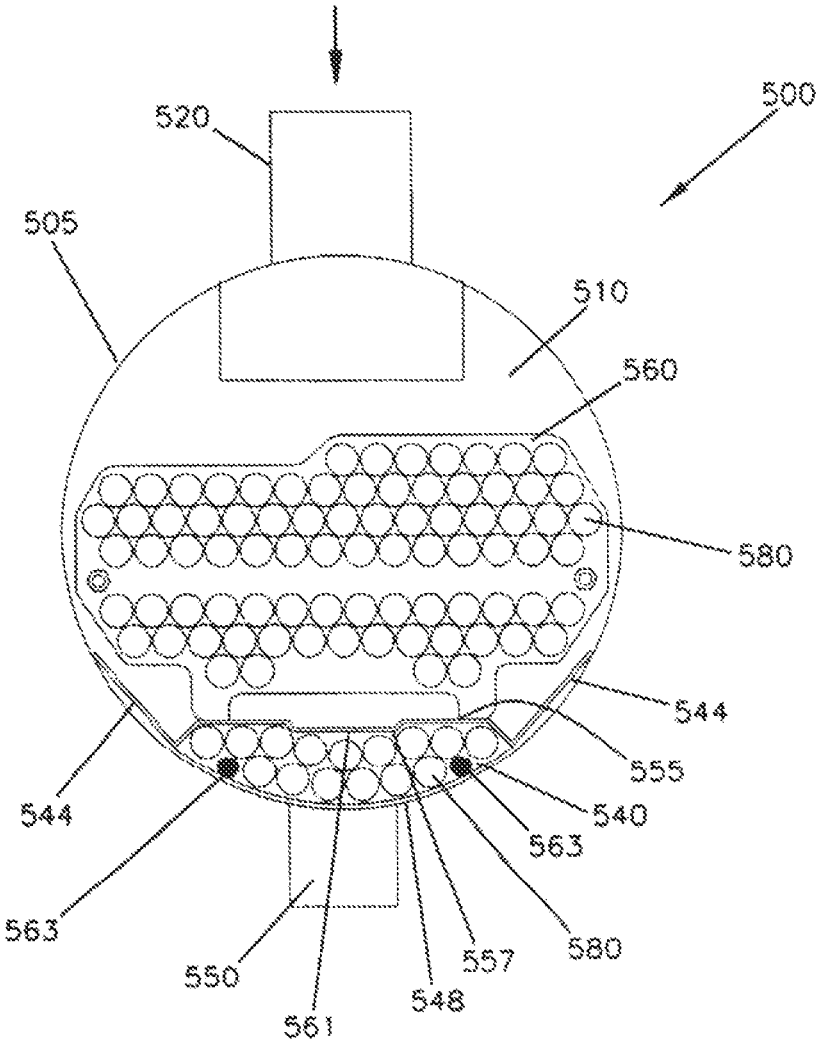
FIGS. 5A to 5C illustrate an embodiment of a condenser with a subcooling section partition.

As illustrated in FIG. 5A, a condenser 500 has a refrigerant inlet 520, a refrigerant outlet 550 and a shell 505. The shell 505 has an internal space 510, which is equipped with heat transfer tubes 580. The heat transfer tubes 580 are generally divided into a cooling section 560 and a subcooling section 540. As illustrated, the subcooling section 540 is generally positioned proximate to a bottom 548 of the shell 505. The subcooling section 540 is generally separated from the cooling section 560 and covered by a partition 555. From the end view as shown in FIG. 5A, the partition 555 has an end profile that generally conforms to an outline of the heat transfer tubes 580 in the subcooling section 540, and also has wings 544 that generally conform to a shape of an internal surface of the shell 505.

Figure 5B:
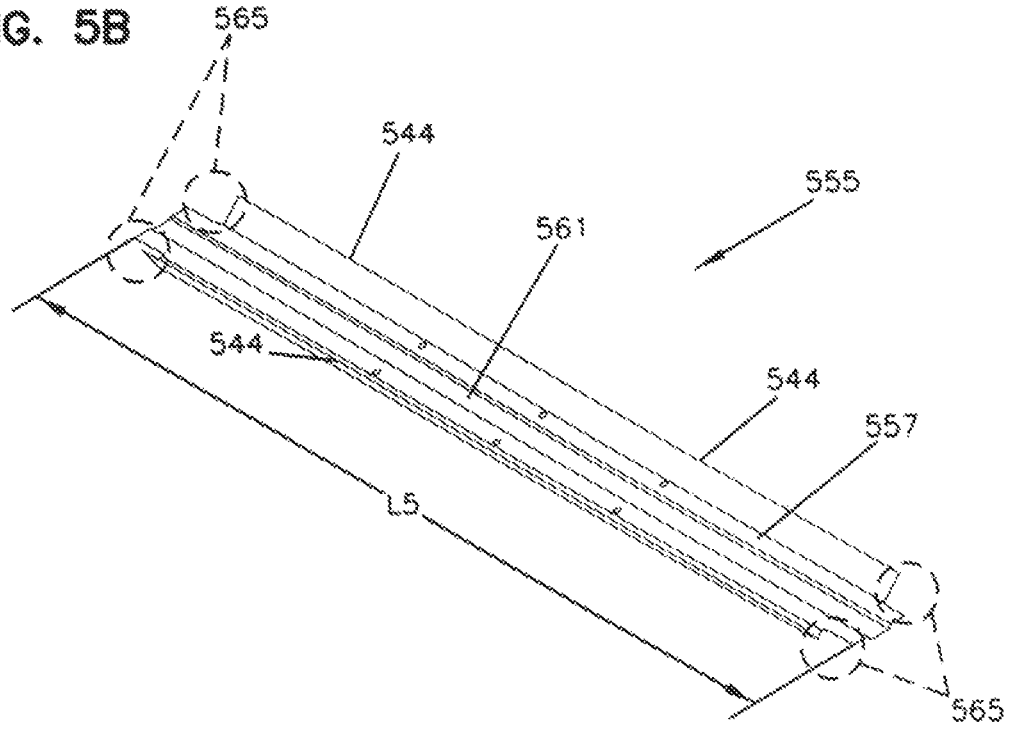

FIG. 5B illustrates an elevated perspective view of the partition 555. The partition 555 has a roof 557 of a length L5 that is generally about the same length as the internal space 510 of the shell 505 (such as the length L2 in FIG. 2). Referring back to FIG. 5A, the roof 557 generally covers a top portion of the subcooling section 540 and generally conforms to the shape of the top portion of the subcooling section 540. The heat transfer tubes 580 that form the top portion of the subcooling section 540 also have a curved outline. The roof 557 of the partition 555 is configured to have a trench 561 so that the end profile of the partition 555 can generally conform to the curved outline of the top portion of the subcooling section 540. By conforming to the outline of the top portion of the subcooling section 540, the partition 555 can help minimize the free space between the partition 555 and the heat transfer tubes 580 of the subcooling section 540.

As illustrated in FIG. 5A, the partition 555 is also configured to have wings 544 that are configured to generally conform to the shape of the internal space of the shell 505. As illustrated in FIG. 5B, the wings 544 do not extend the full length L5 of the roof 557, and are configured to have cut-out regions 565 at end section(s) of the roof 557. The cut-out regions 565 can be configured to allow the refrigerant in the liquid state to escape from the partition 555 and flow down to the subcooling section 540 as illustrated in FIG. 5A. As illustrated in FIG. 5A, the refrigerant outlet 550 is configured to be positioned about a middle section of the length of the shell 505. The refrigerant in the liquid state can be cooled by the heat transfer tubes 580 in the subcooling section 540 when the refrigerant in the liquid state is directed toward the refrigerant outlet 550. It is to be appreciated that the refrigerant outlet 550 can be positioned in any place along the length of the shell.

Figure 5C:
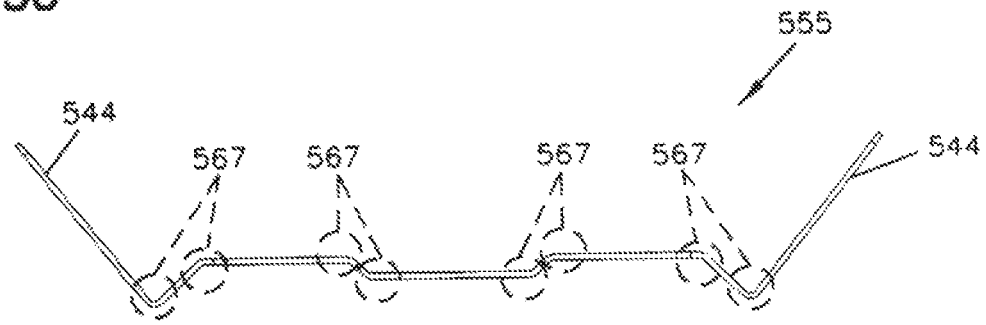

FIG. 5C further illustrates an end view of the partition 555. As illustrated, the wings 544 tilt upwardly and generally conform to the shape of the internal surface of the shell 505. The partition 555 can have a plurality of bends 567 that are configured so that the partition 555 generally conforms to the shape of the outline of the heat transfer tubes 580 of the subcooling section 540 underneath the partition 555. This configuration may help reduce the free space for the refrigerant between the heat transfer tubes 580 and the partition 555, and consequently help increase the contact between the refrigerant in the liquid state and the heat transfer tubes 580 in the subcooling section 540. This can help increase the heat transfer efficiency of the subcooling section 540.

The partition 555 may be fixed to the shell 505 by welding, point welding or intermittent welding inside the shell 505. Generally, the partition 555 is configured to be level in relation to the ground when the shell 505 is installed for operation.

Referring back to FIG. 5A, in some embodiments, the subcooling section 540 may include space filling rod(s) 563 that extends the length of the internal space 510 of the shell 505. The space filling rod(s) 563 can help reduce free flow area between the heat transfer tubes 580 in the subcooling section 540 and the internal surface of the shell 505 thus increasing the contact between the refrigerant and the heat transfer tubes 580, and consequently helping improve the subcooling efficiency.

In operation, the partition 555 can help form the subcooling section 540 with the bottom of the shell 505. The wings 544 can help prevent condensing refrigerant from flowing into the subcooling section 540.

It is to be appreciated that the configuration of the partition 555 is exemplary. The configuration partition 555 can be adapted to different configurations of the subcooling area. Generally, the partition may be configured to cover a top of the subcooling area and shaped to conform to an outline of the subcooling area so as to reduce free flow area between the heat transfer tubes in the subcooling area and the partition. The partition may also be configured to have cut-out regions at an end(s) of the partition to allow refrigerant collected by the partition to flow down to the subcooling area.

Figure 6:
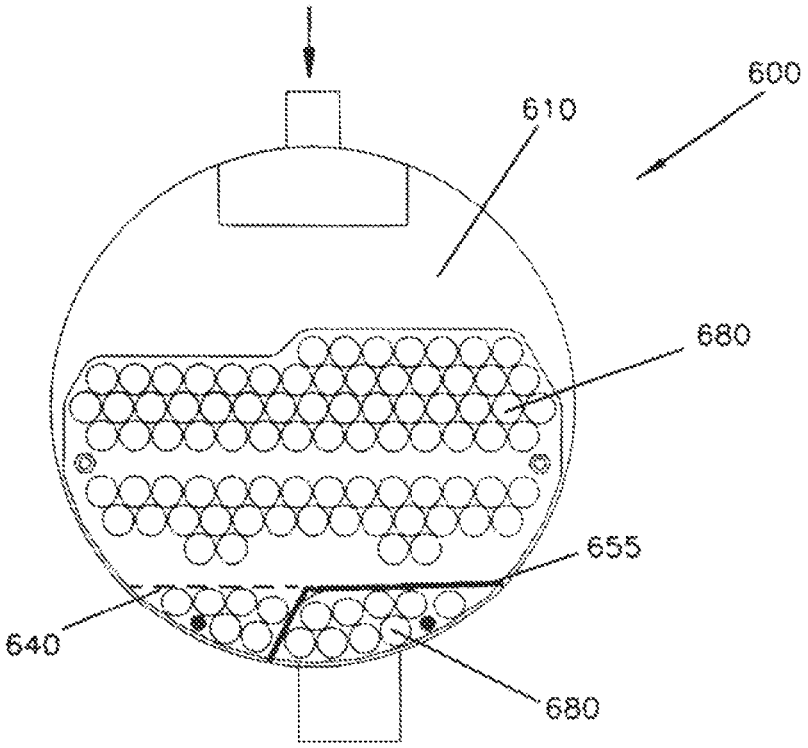
FIG. 6 illustrates yet another embodiment of a condenser with a refrigerant management apparatus.

FIG. 6, illustrates another embodiment of a condenser 600. As illustrated, a partition 655 is configured to only cover a portion of the heat transfer tubes 680 in the subcooling section 640. The partition 655 can be configured to extend generally along a length of an internal space 610 of the condenser 600, but with cut-out region(s) close to an end(s) of the partition 655 to allow refrigerant in the liquid state to flow into the subcooling section 640 through the cut-out region(s)

The material for the partition as illustrated in FIGS. 5A to 5C and 6 can vary. In some embodiments, the partition can be made of copper. In some embodiments, the partition can be made of steel or iron. The partition may be easier and cheaper to make compared to an enclosed subcooling box, thus saving the time and cost of a manufacturing process of the condenser 600.

It is to be appreciated that the features described are exemplary. A condenser may be configured to have anyone (or any combination) of the features described herein.

It is further appreciated that the partition may only have a cut-out(s) at one end of the partition, in contrast to having cut-outs at both ends of the partition 555 as illustrated in FIG. 5B. The refrigerant outlet can be positioned to an end of the condenser that is away from the end where the cut-out(s) are located. Positioning the cut-out(s) away from the refrigerant outlet may help subcool the refrigerant flowing to the subcooling section out of the cut-out(s).

Figure 7:
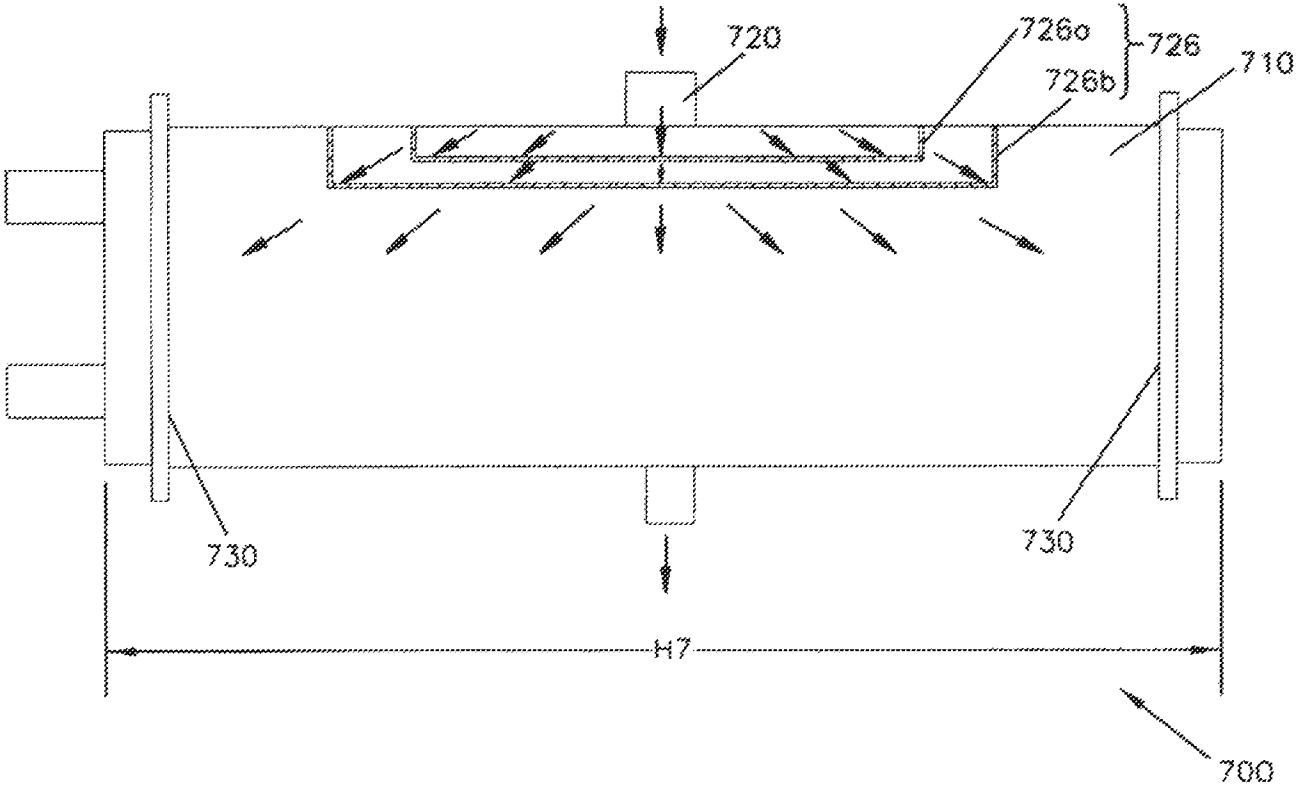
FIG. 7 illustrates an embodiment of a heat exchanger with a two-stage distributor.

FIG. 7 illustrates a schematic side view of a tube and shell heat exchanger 700 with a two-stage refrigerant distributor 26 that is coupled to a refrigerant inlet 720 to help distribute refrigerant into an internal space 710 of the tube and shell heat exchanger 700. The refrigerant distributor 726 is generally positioned in the internal space 710 to cover an opening of the refrigerant inlet 720.

The refrigerant distributor 726 is configured to have a first-stage distributor 726*a* and a second-stage distributor 726*b*. In the illustrated embodiment, the refrigerant inlet 720 is positioned at about a middle section of a length H7 of the tube and shell heat exchanger 700. Both of the first-stage distributor 726*a* and the second-stage distributor 726*b* extend toward both ends 730 of the tube and shell heat exchanger 700, with the extension of the second-stage distributor 726*b* generally being more extensive than the first-stage distributor 726*a*.

Both of the first-stage distributor 726*a* and the second-stage distributor 726*b* may be solid sheets that have distribution openings to allow refrigerant to pass through. (See FIGS. 8A and 8B and the description below for embodiments of the openings.) The openings can have various configurations, such as slots, round holes (see FIGS. 8A and 8B), etc. In some embodiments, at least a portion of the distributions openings in the first-stage distributorcan be aligned with at least a portion of the distributions openings in the second-stage distributor. In some embodiments, at least a portion of the distributions opening in the first-stage distributor can be off-set from the distribution openings in the second-stage distributor. In some embodiments, one of the distributors may be solid sheet without openings. For example, the first-stage distributor may be a sheet metal without distribution openings, while the second-stage distributor may be a sheet metal with distribution openings. In some embodiments, the first-stage distributor may be a member with pores, such as illustrated in FIG. 8E bellow.

The arrows in FIG. 7 illustrate an exemplary distribution of refrigerant vapor inside the tube and shell heat exchanger 700. In operation, the refrigerant vapor is charged into the infernal space 710 through the refrigerant inlet 720. The refrigerant vapor is firstly distributed by the first-stage distributor 726*a*. The distribution openings of the first-stage distributor 726*a* allows a portion of the refrigerant vapor to pass through, while a solid portion of the first-distributor 726*a* directs another portion of the refrigerant vapor toward the ends 730 in a longitudinal direction of a length H1 along the first-stage distributor 726*a*.

After passing through the distribution openings of the first-stage distributor 726*a*, the refrigerant vapor is distributed again by the second-stage distributor 726*b*. Similar to the first-stage distributor 726*a*, the distribution openings of the second-stage distributor 726*b* allows a portion of the refrigerant vapor to pass through, while a solid portion of the second-distributor 726*b* directs another portion of the refrigerant vapor toward the ends 730 along the second-stage distributor 726*b*. The first and second-stage distributors 726*a* and 726*b* can work together to distribute the refrigerant vapor in the longitudinal direction that is defined by the length H7 of the tube and shell heat exchanger 700, and help distribute refrigerant evenly along the length H7.

Sizes of the first-stage distributor 726*a* and the second-stage distributor 726*b* may vary. Generally, the size of the second-stage distributor 726*b* is larger than the first-stage distributor 726*a*. Particularly, the second-stage distributor 726*b* is generally longer than the first-stage distributor 726*a* in the longitudinal direction defined fey the length H7. In some embodiments, the first-stage distributor 726*a* and/or the second-stage distributor 726*b* may extend to close to a full length of the length H7. In some embodiments, the first-stage distributor 726*a* and/or the second-stage distributor 726*b* may be shorter than the full length of the length H7.

In an embodiment where the first-stage distributor 726*a* is a solid sheet without distribution openings, the first-distributor 726*a* can redirect/disperse the refrigerant vapor charged from the refrigerant inlet 720 to the longitudinal direction defined by the length H7 of the tube and shell heat exchanger 700. The second-stage distributor 726*b* can then distribute the refrigerant vapor into the internal space 710.

The embodiments of the two-stage distributors as described herein are exemplary. The general principle is that both of the first-stage and second-stage distributors may be configured to direct at least a portion of the refrigerant vapor in the longitudinal direction that is defined by the length of the heat exchanger, while at the same time allow a portion of the refrigerant vapor to pass through the distributors. In some embodiments, the first-stage distributor can be configured to also redirect almost all of the refrigerant vapor charged into the refrigerant inlet in the longitudinal direction that is defined by the length of the heat exchanger. The two-stage distributor helps evenly distribute refrigerant in the longitudinal direction that is defined by the length of the heat exchanger so that the refrigerant vapor does not accumulate around the area where the refrigerant inlet is.

In some embodiments, the first distributor and the second distributor may be configured so that one of the distributor may preferably help distribute the refrigerant vapor evenly in the longitudinal direction, while the other distributor may be configured to preferably help distribute refrigerant vapor evenly in a radial direction that is generally perpendicular to the longitudinal direction.

Figure 8A:
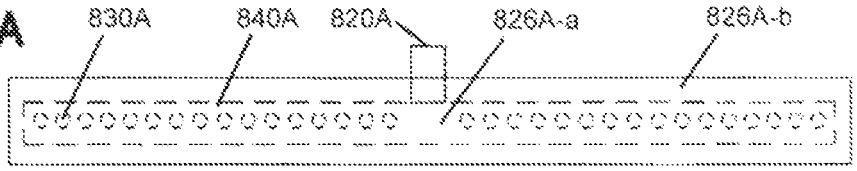
FIG. 8A to 8E illustrate embodiments of two-stage distributors.
Figure 8B:
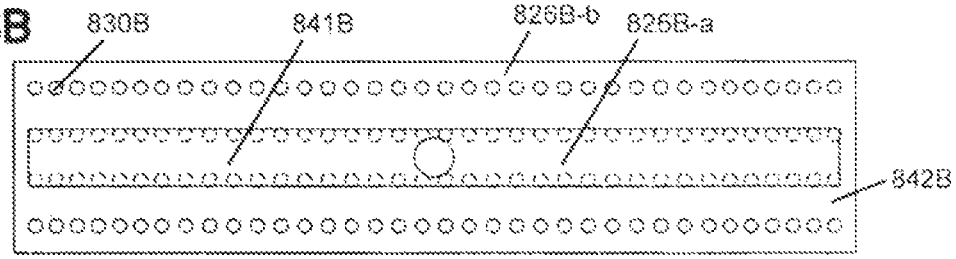
Figure 8C:
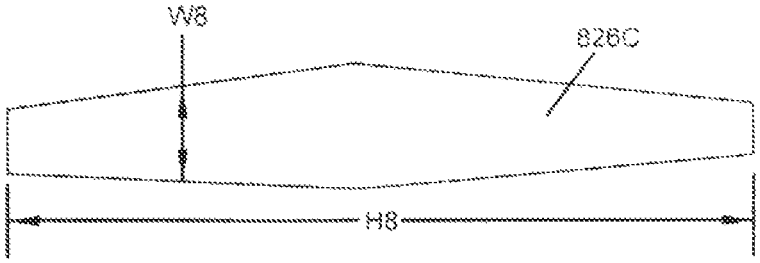
Figure 8D:
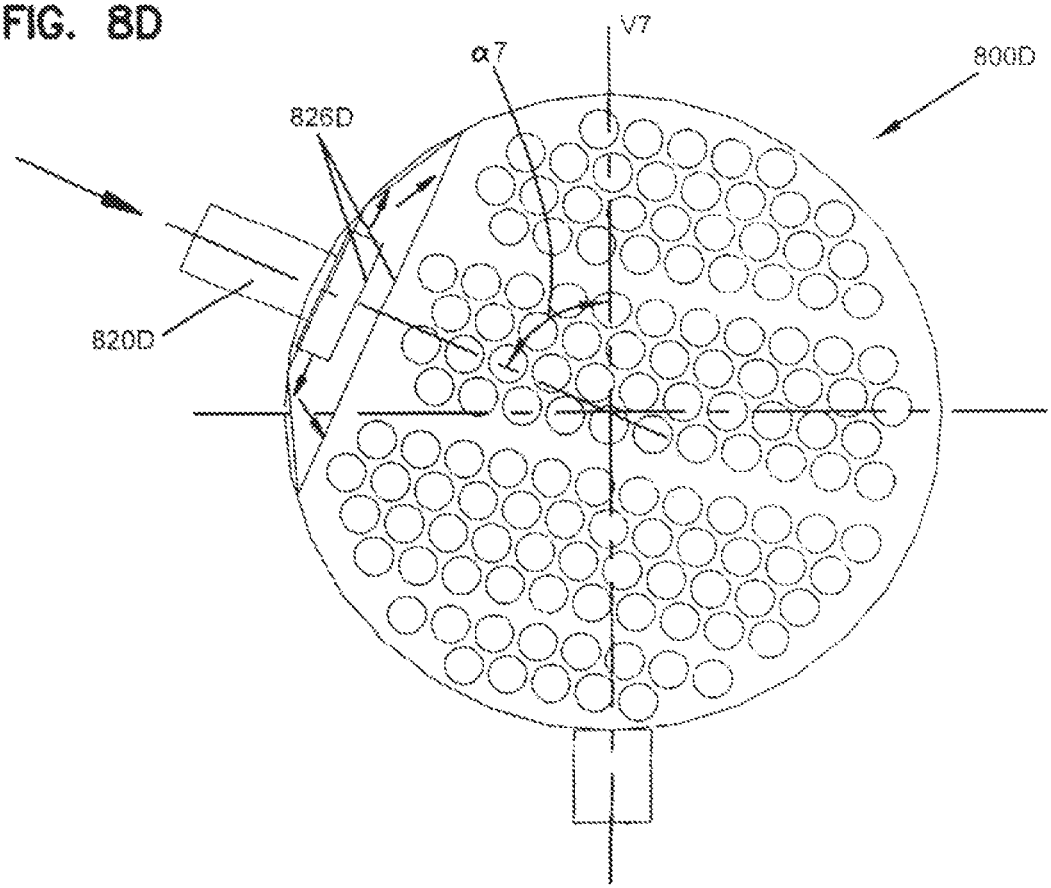
Figure 8E:
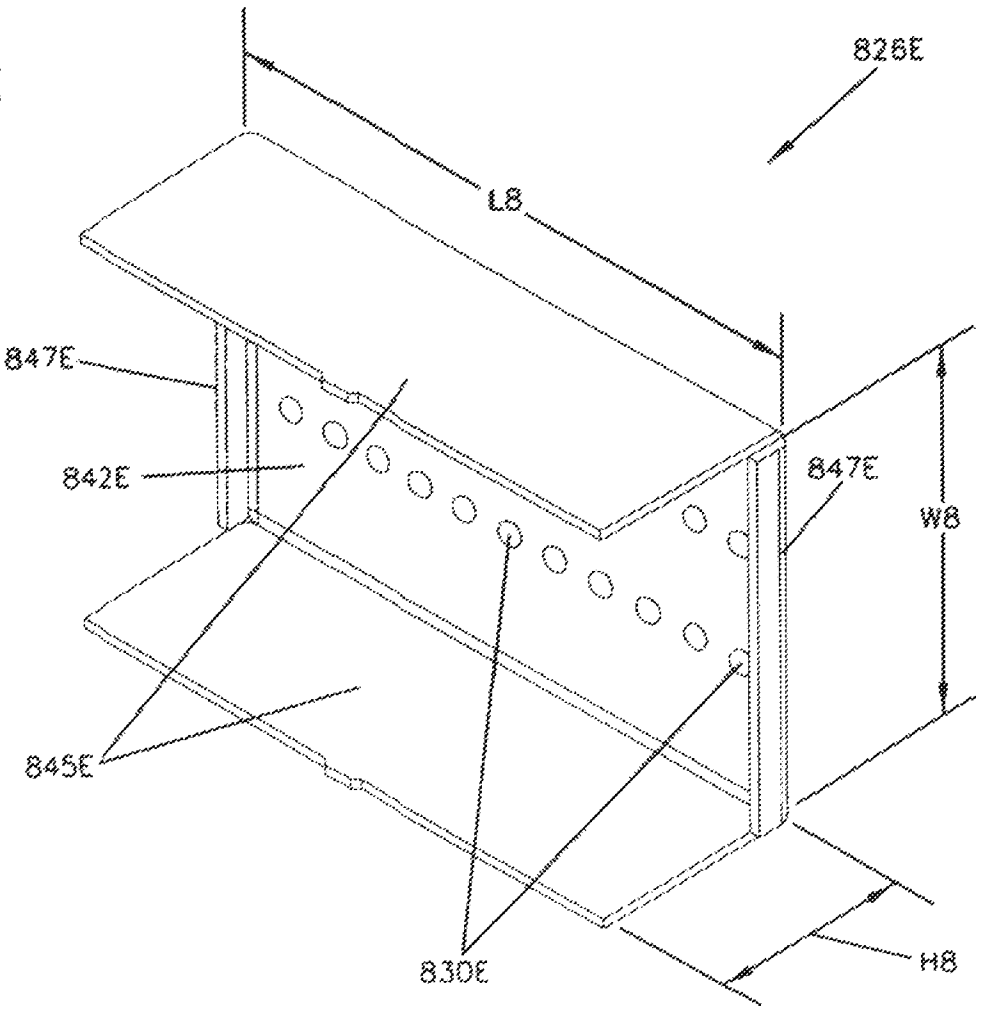

FIGS. 8A to 8E illustrate different embodiments of refrigerant distributers. FIG. 8A is a side view of an embodiment of a two-stage distributor, which includes a first stage distributor 826A-*a* that is generally disposed beneath a refrigerant inlet 820A, and a second stage distributor 826A-*b*. As illustrated, the second distributor 826A-*b* is generally longer that the first stage distributor 826A-*a*. The first stage distributor 826A-*a* is configured to have a row of openings 830A on a side wall 840A of the first stage distributor 826A-*a* so that refrigerant vapor can be distributed along the side wall 840A.

It is to be appreciated that the first stage distributor may be configured to have no openings on the side wall and/or a bottom, but have an end opening(s) formed by the first stage distributor and an inside wall of a condenser. As a result, the first stage distributor only directs refrigerant toward the end opening(s). In some embodiments, the first stage refrigerant distributor may be configured to be shorter than the second stage refrigerant distributor. In some embodiments, the first stage distributor and/or the second stage may be configured to have closed ends.

FIG. 8B is a top view of another embodiment of a two-stage distributor. As illustrated, the two-stage distributor includes a first-stage distributor 826B-*a* and a second-stage distributor 826B-*b*. As illustrated, the first-stage distributor 826B-*a* is generally narrower than the second-stage distributor 826B-*b*. The first stage distributor 826B-*a* is configured to have no openings on a bottom 841B. The second-stage distributor 826B-*b* is configured to have a plurality of rows of openings 830B on a bottom 842B. The openings 830B can help distribute refrigerant into a condenser.

It is to be noted that diameters of openings 830A and 830B as illustrated in FIGS. 8A and 88 can vary. In some embodiments, the openings 830A and 830B can be configured to have a diameter in the range of 15-40 mm. In some embodiments, the distance between the first stage distributor (i.e. 826A-*a* or 826B-*a*) and the second stage distributor (i.e. 826A-*b* and 826B-*b*) can be in the range of 5 to 25 mm.

In FIGS. 8A and 8B, the first distributors 826A-*a*, 826B-*a* and the second distributors 826A-*b*, 826B-*b* are configured to have a roughly rectangular profile. FIG. 8C illustrates that a distributor 826C, which can be configured as the first-stage distributor and/or the second-stage distributor, may have other profiles. Openings are omitted from the drawing. Particularly, the profile of the 826C distributor may have a variable geometry along a longitudinal direction defined by a length H8 of the distributors 826C. In the embodiment as illustrated in FIG. 8C, the geometry of the distributor 826C has a changing width W8 along the length H8 of the distributor 826C. The width W8 is wider toward a middle line of the distributor 826. The distributor 826C may have distribution openings, such as, for example, the distributing opening as illustrated in FIGS. 8A and 8B.

FIG. 8D illustrates another embodiment of a heat exchanger 800D, where a refrigerant inlet 820D is positioned at a side of the heat exchanger 800D. Accordingly, a two-stage distributor 826D is also positioned at an angle $\alpha$7 to a vertical direction V7 of the heat exchanger 800D. The range of the angle $\alpha$7 can be from 0 to 90 degrees. In some embodiments, the angles $\alpha$7 can be about 90 degrees, 60 degrees, 45 degrees, and 30 degrees. By positioning the refrigerant inlet 820D and the distributor 826D diagonally in relation to the vertical direction V7, the refrigerant vapor can be directed from the side of the heat exchanger 800. (See FIGS. 3, 4A and 4C for more embodiments with diagonally positioned distributors.) In a heat exchanger with pans (e.g. the condenser 300 as illustrated in FIG. 3), the pans may block some of the refrigerant vapor flow in the vertical direction. As illustrated in FIG. 3, positioning the distributor at an angle in relation to the vertical direction can help reduce the blocking effect of the pans.

FIG. 8E illustrates another embodiment of a distributor 826E that can be configured as a first-stage distributor and/or a second-stage distributor as described above. As illustrated, the distributor 826E has a length L8, a width W8 and a height H8. A bottom 842E is configured to have a plurality of openings 830E, although it is appreciated that the bottom 842E may be configured to have no openings in other embodiments.

The distributor 826E includes two side walls 845E extending along a longitudinal direction that is defined by the length L8. When installed, the longitudinal direction defined by the length L8 can be configured to be generally parallel to the longitudinal direction of a shell of a condenser (e.g. the longitudinal direction defined by the length H7 in FIG. 7). In the illustration, the side walls 845E are configured to have no openings. It is to be understood that in other embodiments, the side walls 845E can be configured to have openings similar to the openings 830A as illustrated in FIG. 8A. To install the distributor 826E, the distributor 826E may be disposed underneath a refrigerant inlet of a shell of a heat exchanger and the side walls 845E can be attached to an insider surface of the shell by, for example, welding or bracketing. The length L8 can be about the same as or shorter than the length of the shell.

Sides 847E of the bottom 842E along the width W8 are configured to have no walls, although the sides 847E along the width W8 can be configured to have side walls. When the distributor 826E is installed, the sides 847E may form end openings with the inside surface of the shell of the condenser. Refrigerant can be distributed through the end openings. In some embodiments, the sides 847E along the width W8 can be configured to have side walls, and the side walls can be configured to have a height that is the same as H8 or less than H8.

It is to be appreciated that the distributors can be made of, for example, steel plates. In some embodiment, the thickness of the steel plates can be from 4 to 10 mm.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A heat exchanger comprising: a shell, the shell having two ends that define an internal space, the internal space having a length and a height; a refrigerant inlet; a first stage distributor positioned next to the refrigerant inlet in the internal space of the heat exchanger, the first stage distributor extending in a longitudinal direction of the length of the heat exchanger; and a second stage distributor positioned next to the first stage distributor in the internal space of the heat exchanger, the second-stage distributor extending in the longitudinal direction of the length of the heat exchanger;

a plurality of heat transfer tubes running in a longitudinal direction of the length of the shell in the internal space; and a first separation/collection pan having a first end and a second end, the first separation/collection pan extending from the first end to the second end in a direction of the length of the internal space of the shell and positioned within the plurality of heat transfer tubes, where the plurality of heat transfer tubes configured to cool a refrigerant in a vapor state so that at least a portion of the refrigerant in the vapor state transits to a liquid state, wherein the first separation/collection pan is configured to separate a subcooling section from other portions of the internal space, a length of the first separation/collection pan is about the same as the length of the internal space of the shell, the first separation/collection pan includes a first wing extending along a first side of the first separation/collection pan in the longitudinal direction of the length of the internal space of the shell, the first wing tilts upwardly, and the first separation/collection pan includes a second wing, the first separation/collection pan is configured to direct at least a portion of the refrigerant in the liquid state along the longitudinal direction of the length of the internal space of the shell, and toward an end of the internal space of the shell, the first separation/collection pan has a plurality of bends that are configured so that the first separation/collection pan generally conforms to an outline of heat transfer tubes of the subcooling section underneath the first separation/collection pan, the plurality of bends is disposed between the first wing and the second wing, and the first wing of the first separation/collection pan is configured to have cut-out regions at the first end and at the second end of the first separation/collection pan.

2. The heat exchanger of claim 1, the heat exchanger may be configured so that the refrigerant inlet is positioned diagonally in relation to a vertical direction defined by the height of the internal space of the shell.

3. A condenser comprising:

a shell, the shell having two ends that define an internal space, the internal space having a length and a height;

at least a portion of the internal space in the height of the internal space having a plurality of heat transfer tubes running in a longitudinal direction of the length of the shell, the plurality of heat transfer tubes configured to cool a refrigerant in a vapor state so that at least a portion of the refrigerant in the vapor state transits to a liquid state; and a first separation/collection pan having a first end and a second end, the first separation/collection pan extending from the first end to the second end in a longitudinal direction of the length of the internal space of the shell and positioned within the plurality of heat transfer tubes, wherein the first separation/collection pan is configured to separate a subcooling section from other portions of the internal space, a length of the first separation/collection pan is about the same as the length of the internal space of the shell, the first separation/collection pan includes a first wing extending along a first side of the first separation/collection pan in the longitudinal direction of the length of the internal space of the shell, the first wing tilts upwardly, and the first separation/collection pan includes a second wing, the first separation/collection pan is configured to direct at least a portion of the refrigerant in the liquid state along the longitudinal direction of the length of the internal space of the shell, and toward an end of the internal space of the shell, the first separation/collection pan has a plurality of bends that are configured so that the first separation/collection pan generally conforms to an outline of heat transfer tubes of the subcooling section underneath the first separation/collection pan, the plurality of bends is disposed between the first wing and the second wing, and the first wing of the first separation/collection pan is configured to have cut-out regions at the first end and at the second end of the first separation/collection pan.

4. A method of managing the refrigerant in the condenser of claim 3, comprising:

directing the refrigerant in the vapor state into the internal space of the condenser;

cooling the refrigerant in the vapor state so that at least a portion of the refrigerant in the vapor state transits into the liquid state;

directing at least a portion of the refrigerant in the liquid state toward proximately the end of the internal space of the condenser;

at proximately the end of the internal space of the condenser, directing the at least a portion of the refrigerant in the liquid state toward a bottom of the internal space of the condenser; and directing the at least a portion of the refrigerant in the liquid state toward a refrigerant outlet located at proximately a middle section of the bottom of the internal space of the condenser.

5. The method of claim 4 further comprising:

during directing the at least a portion of the refrigerant in the liquid state toward the refrigerant outlet located proximately the middle section of the bottom of the internal space of the condenser, cooling at least a portion of the refrigerant in the liquid state.

6. The method of claim 4 further comprising:

collecting at least a portion of the refrigerant in the liquid state at a plurality of height levels along a height of the internal space of the condenser.

7. The condenser of claim 3, wherein the first separation/collection pan is configured to direct at least a portion of the refrigerant liquid toward proximately both ends of the internal space in the longitudinal direction of the internal space along the first separation/collection pan.

8. The condenser of claim 7, wherein a space is formed between each of the first and the second ends of the first separation/collection pan and each of the two corresponding ends of the shell for directing the at least a portion of the refrigerant liquid toward the both ends of the internal space.

9. The condenser of claim 3, wherein the second wing extends along a second side of the first separation/collection pan in the longitudinal direction of the length of the internal space of the shell, and the second wing tilts upwardly.

10. The condenser of claim 3, wherein the subcooling section includes a space filling rod that extends the length of the internal space.

11. The condenser of claim 3, wherein the first wing of the first separation/collection pan is configured to generally conform to a shape of the internal space.

* * * * *